US008756809B1

(12) United States Patent
Slavik

(10) Patent No.: US 8,756,809 B1
(45) Date of Patent: Jun. 24, 2014

(54) LANCE AND SLIT SEAMED HOUSING AND METHOD OF MANUFACTURE

(75) Inventor: Larry Slavik, St. Louis, MO (US)

(73) Assignee: Custom Rollform Products, Inc., St. Louis, MO (US)

( * ) Notice: Subject to any disclaimer, the term of this patent is extended or adjusted under 35 U.S.C. 154(b) by 0 days.

(21) Appl. No.: 13/532,333

(22) Filed: Jun. 25, 2012

Related U.S. Application Data

(62) Division of application No. 12/384,798, filed on Apr. 9, 2009, now Pat. No. 8,235,659.

(60) Provisional application No. 61/124,127, filed on Apr. 15, 2008.

(51) Int. Cl.
*B21D 53/02* (2006.01)

(52) U.S. Cl.
USPC ..... 29/890.03; 415/203; 415/204; 415/206

(58) Field of Classification Search
USPC ..... 415/203, 204, 206, 215.1; 29/890.03
See application file for complete search history.

(56) References Cited

U.S. PATENT DOCUMENTS

| | | | | | |
|---|---|---|---|---|---|
| 3,653,116 | A | * | 4/1972 | Lov et al. | 29/243.517 |
| 3,775,029 | A | * | 11/1973 | Ranz | 417/353 |
| 5,158,432 | A | * | 10/1992 | Cox | 415/214.1 |
| 5,690,470 | A | * | 11/1997 | Zimmer | 415/214.1 |
| 5,739,501 | A | * | 4/1998 | Peterson | 219/117.1 |
| 2008/0193284 | A1 | * | 8/2008 | Hoeffken | 415/203 |

* cited by examiner

*Primary Examiner* — David Bryant
*Assistant Examiner* — Ruth G Hildalgo-Hernande
(74) *Attorney, Agent, or Firm* — Kevin L. Klug

(57) ABSTRACT

A lanced and/or slit seamed housing and method of manufacture having a peripheral rolled and lanced or punched seam between a wrapper and the housing panels. The method of manufacture utilizes similar or dissimilar sheet materials in a variety of material thicknesses and with or without coatings applied prior to formation whereby a housing is formed quickly and safely. The rolling and lancing method manufactures a blower housing with an assured and positive sealed seam between the panels and wrapper of the housing. The lances or slits maintain the integrity of the seam and prevent slippage between the wrapper and panels.

10 Claims, 21 Drawing Sheets

LANCE AND SLIT SEAMED HOUSING AND METHOD OF MANUFACTURE

This application is a Divisional Application of U.S. patent application Ser. No. 12/384,798, filed on Apr. 9, 2009 now U.S. Pat. No. 8,235,659. This application claims priority of U.S. Provisional Patent Application No. 61/124,127, filed Apr. 15, 2008, entitled Lance and Slit Seamed Housing and Method of Manufacture.

BACKGROUND OF THE INVENTION

The art of the present invention relates to sheet metal housings in general and more particularly to blower fan housing assemblies used in heating ventilating and air conditioning (HVAC) systems. The present art apparatus and method of manufacture continuously forms a rolled, lanced, and/or slit seam which locks the housing sides or panels with a perimeter wrapper sheet. The manufacturing apparatus and method of manufacture uniquely rotates two housing sides or panels and a preformed perimeter wrapper through one or more rollers which form a lanced and/or slit seam at the perimeter interface of the panels and wrapper.

Housings of various sizes and configurations are often employed in forced air furnaces and/or air conditioners and typically have a blower mounted therewith. The blower provides the ventilating air flow for heating, ventilating, and air conditioning systems. That is, the ventilating air flow forced through or over a heat exchanger or evaporator provides the desired air heating or cooling. A conventional blower housing is generally manufactured from sheet metal often having a painted, galvanized, or aluminized coating. The housing typically supports the blower (in the form of a powered blower wheel) and comprises two blower sides or panels with a wrapper sheet formed and attached around a perimeter interface. The blower wheel creates the required high volume of air flow. The wrapper sheet is substantially positioned between and formed or wrapped around a substantially parabolic radius contour of the two blower housing panels with a seam or joint peripherally created there between. The seam or joint must secure or lock the panels and wrapper whereby lateral or radial movement there between is prohibited during powered blower operation. The seam or joint must also prohibit any air flow leakage from the housing perimeter or peripheral interface.

Prior art seaming or joining of the wrapper to the housing panels varies from manufacturer to manufacturer and includes welding, flanging, or stacking of the panels and wrapper. Many manufacturers form a flange on either the wrapper or the panels and spot weld the combination of panels and wrapper around the perimeter interface. This prior art method of attachment is time consuming, labor intensive, and often represents a health and safety risk to the assembler. It is also prohibits coating of the sheet metal with a non-conductive coating prior to assembly. Other manufacturers utilize one or more discrete stakes, punches, or crimps around the seam. These prior art methods eliminate some of the safety and environmental issues associated with welding but are also time consuming and labor intensive, and often produce a seam which is inferior to the aforementioned welded seam.

The prior art housing assembly techniques and equipment are also dedicated or designed to produce only one type, style, diameter, or width of blower housing and utilize a specific thickness of sheet metal. HVAC equipment utilizes many different types, styles, diameters, and widths of blower housings in order to satisfy the air flow requirements of the system and the environment served. Different sizes of blower housings also utilize different thicknesses of sheet metal. Many of the prior art housing assembly techniques and equipment are also dedicated or designed for a specific sheet metal thickness.

The present art utilizes a continuous roll and lance (or slit) lock method which produces a superior rolled seam in less time than the prior art welding, punching, staking, or crimping systems. The present art assembly apparatus also allows a manufacturer to produce a wide variety of housing types, styles, diameters, or widths with a minimal setup or changeover adjustment. The present art also accommodates a plurality of sheet metal thicknesses and material types. Although rollforming of seams between flat sheet metal materials is recognized within various industries, simultaneous rollforming and lancing of housings or blower housings has not heretofore been performed. That is, it is difficult to create a uniform rolled and lanced seam on the parabolic peripheral geometry of the housing.

The present art blower housing and method of manufacture incorporates a continuous lance and/or slit rolled seam at the housing peripheral interface which closes and interlocks the edge flanges of the wrapper and panels together. For the preferred embodiment, the preformed housing side panels are inserted into preformed wrapper edge flanges and the resultant edge flange/panel sandwich is fed through one or more specially formed rollers which peripherally lance/slit, and roll the edge seams (i.e. a sandwich) with a single and continuous operation. That is, both sides are locked and seamed simultaneously as the lance and slit rollers follow around the outer perimeter or periphery of the housing. This configuration simultaneously locks the panels and wrapper together to form a seam without a lateral or radial movement between the wrapper and panels. The locking and seaming technique allows the housing to withstand blower loads and vibrations without failure and prohibits any gap between the panels and wrapper through which air leakage could occur.

The present art method of manufacture allows the blower housing to be constructed from different types and thickness of sheet materials and further allows the sheet materials to be coated, i.e. painted, galvanized, aluminized, or of dissimilar metals prior to assembly. No primary indexing cycles or secondary welding, punching, staking, or flanging operations are required. The rollers and holding fixture or chuck height and width is fully adjustable for any type of housing style, diameter, width, or material thickness.

Accordingly, it is an object of the present invention to provide a lance/slit seamed housing and method of manufacture which provides a secure rolled and lanced/slit seam between the housing side panels and the peripheral wrapper in a quick, easy, and safe manner.

Another object of the present invention is to provide a lance/slit seamed housing and method of manufacture which provides a continuously rolled seam without gaps and does not require primary indexing or secondary punching, crimping, or staking operations.

A further object of the present invention is to provide a lance/slit seamed housing and method of manufacture which may utilize pre painted or coated materials having a plurality of thicknesses and compositions.

A still further object of the present invention is to provide a lance/slit seamed housing and method of manufacture which is quickly and easily capable of formation into a plurality of blower housing styles, types, diameters, or widths.

A yet further object of the present invention is to provide a blower housing and method of manufacture which is easy and economical to manufacture in a variety of sizes with the same assembly machines.

A yet further object of the present invention is to provide a blower housing and method of manufacture having locking lances or slits and which provides a substantially smooth seam.

SUMMARY OF THE INVENTION

The art of the present invention comprises a lance and/or slit seamed housing and method of manufacture. The assembly apparatus is designed to simultaneously form the blower housing wrapper around two blower housing sides or panels and peripherally lock seam them together to produce a complete blower housing unit. As the wrapper is formed around the blower housing sides one or more rollers join and interlock the wrapper and panel periphery in order to form a continuous peripheral lanced seam. In the preferred embodiment, rollers having integral lance and slit punches form the continuous peripheral seam which joins the panels and wrapper. That is, the rollers have one or more lancing extensions or protrusions which perform the lancing as the peripheral seam is rolled. In the preferred embodiment, both sides of the housing are lanced and seamed simultaneously as the housing is rotated approximately 180 to 210 degrees during a feed cycle.

The preferred embodiment of the assembly apparatus first consists of two opposed rotary actuator assemblies and two sets of rotary lance and slit punch roller assemblies. The rotary actuator assemblies and lance and slit roller assemblies are preferably adjustably positioned on a table, frame, or structure for easy user access. An embodiment of the assembly apparatus fixes a first rotary actuator assembly and a first lance and slit roll assembly onto a frame or weldment. The second rotary actuator assembly and second lance and slit roller assembly are mounted on horizontal slides whereby adjustment for a wider range of housing depths or wrapper widths is provided. Front and rear guides or seats are positioned onto said table, frame, structure, or weldment or integral with the roller assemblies and guide the panels and wrapper and assist in the seam forming process.

Each rotary actuator assembly has a fixture which is sized to mate with or at the venturi opening of a respective side panel. The fixture can further be described as a clamp plate, a mandrel, a chuck, a faceplate, a center, a fixture plate, or a spindle. In a preferred embodiment, the fixtures fit within or at each venturi opening and hold each left and right side panel in place throughout a seaming feed cycle. That is, the fixtures maintain alignment of the panels with the rollers and wrapper as rotation is imparted to the housing and the lance and/or slit rolled seam is formed. The aforesaid fixtures may further be shaped to accommodate other variations of housings which do not have the conventional venturi opening.

During the method of manufacture, the rotary actuator assemblies simultaneously rotate the blower housing sides or panels (or allow the rollers to perform the rotation) and thereby feed the panel edges into the wrapper edge flanges or pockets while the lance and slit rollers continuously seam, pinch, and lance the peripheral interface. An alternative embodiment utilizes one or more punches to punch the periphery of the housing panels periphery or wrapper perimeter edge flanges. As the housing panels rotate, the fixtures may approach or retract from the slit and punch rollers, each preferably via a riser cylinder or vertical positioner, in order to follow the peripheral curvature (generally parabolic) of the blower housing sides. The camming action of the housing may also serve to raise or lower fixtures without assistance from a riser cylinder or vertical positioner with the riser cylinder or vertical positioner utilized to initially position the fixtures. Each assembly apparatus utilizes a set of preprogrammed positioning data points for each side panel form which assures a positive insertion of the panel edges into the wrapper edge flanges or pockets as the rollers lance, slit, and seam the periphery of the wrapper and side panels together.

During operation, the lance and slit roller assemblies are positioned and aligned with the blower housing sides and the edges of the wrapper. As many housings have at least a portion of the periphery which is a substantially straight edge, the lance and slit rollers are moveable in an axis substantially parallel with the wrapper periphery. This allows the rollers to engage and seam any housing peripheral edge portion which is substantially straight or linear. During this substantially linear seaming operation, the blower housing sides or panels may be held in a substantially fixed position and the rollers traverse the linear portion of the wrapper flange. After the straight flange is formed, the center axis of the rollers are substantially aligned in a vertical axis which intersects or parallels the center axis of the rotary actuators. The housing is then rotated via the rotary actuator assemblies or via the action of the rollers to seam and lance lock the curved portion of the wrapper periphery.

During operation, the operator loads both the left and right blower panels or sides onto the respective rotary actuator fixtures. The pre-rollformed wrapper is set into the guides or onto the seats and the edge flanges are aligned with the blower housing sides and the lance, slit, and punch roller sets. The operator then starts the automatic cycle. Each blower panel or side is lowered into the wrapper edge flanges, the lance, slit, and punch rollers feed around the perimeter of the blower housing assembly and form a completed blower housing in a single feed form cycle.

The lance and slit seamed housing is typically manufactured from sheet metal, preferably sheet metal which is either inherently corrosion resistant or coated to provide corrosion resistant properties. Typical sheet metals include but are not limited to stainless steel, aluminum, and coated steel products, such as pre-painted steel, galvanized steel, Galvalume® steel, aluminized steel or other painted or coated steels. The sheet metal would typically have a thickness range of 16-26 gauge, as conventionally measured within the sheet metal industry but may have other thicknesses as well. The art of the present invention may also be utilized with non-metallic sheet materials such as polymers and composites. The assembly apparatus may be manufactured from a plurality of materials as recognized by one of ordinary skill when taken in conjunction with the description of each element of the apparatus. In the preferred embodiment, the rollers, rotary actuator assemblies, fixtures, and frame(s) are manufactured from a steel material.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
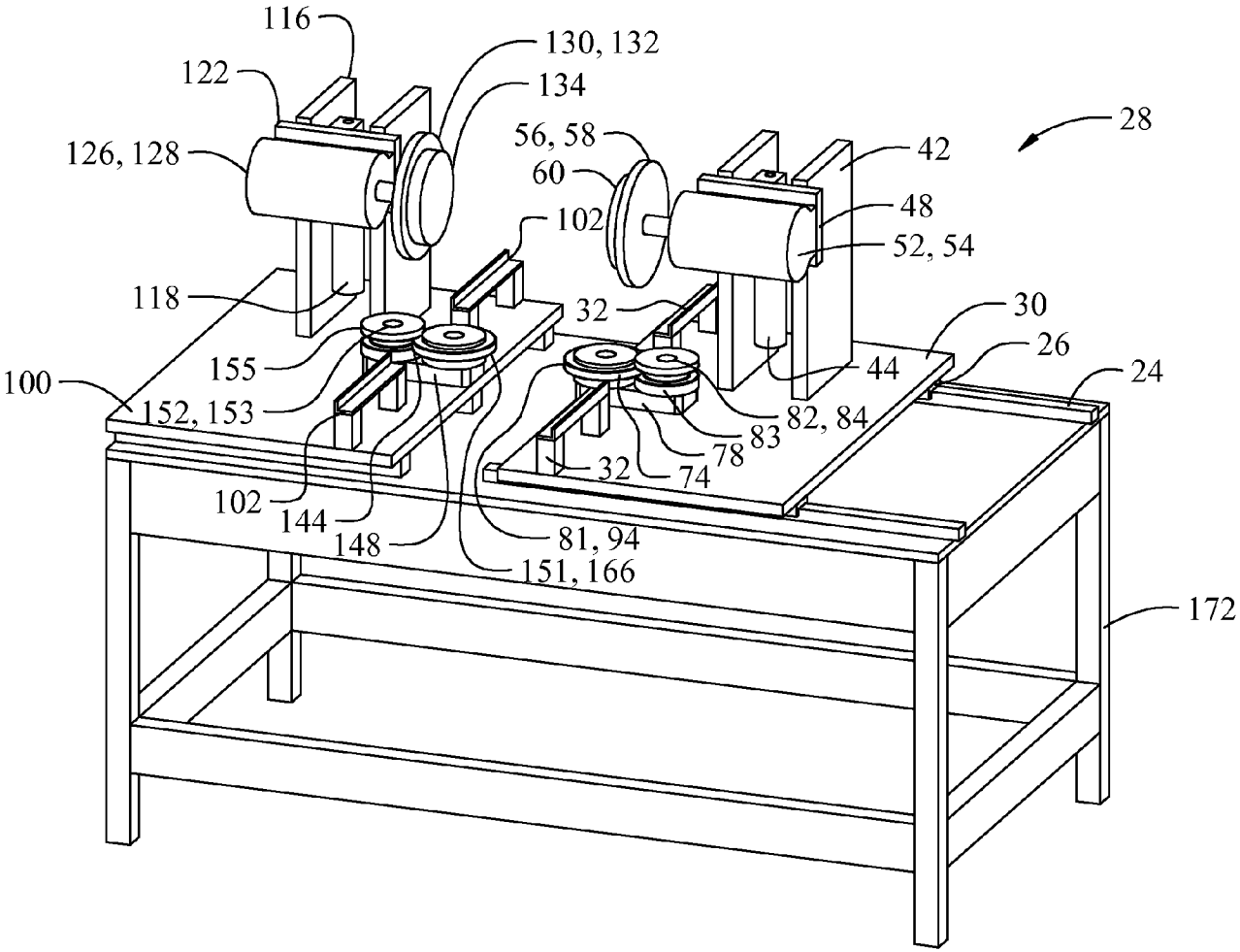
FIG. 1 is a right front diagrammatical perspective view of the preferred embodiment of the apparatus for manufacturing the lance and slit seamed housing.
Figure 2:
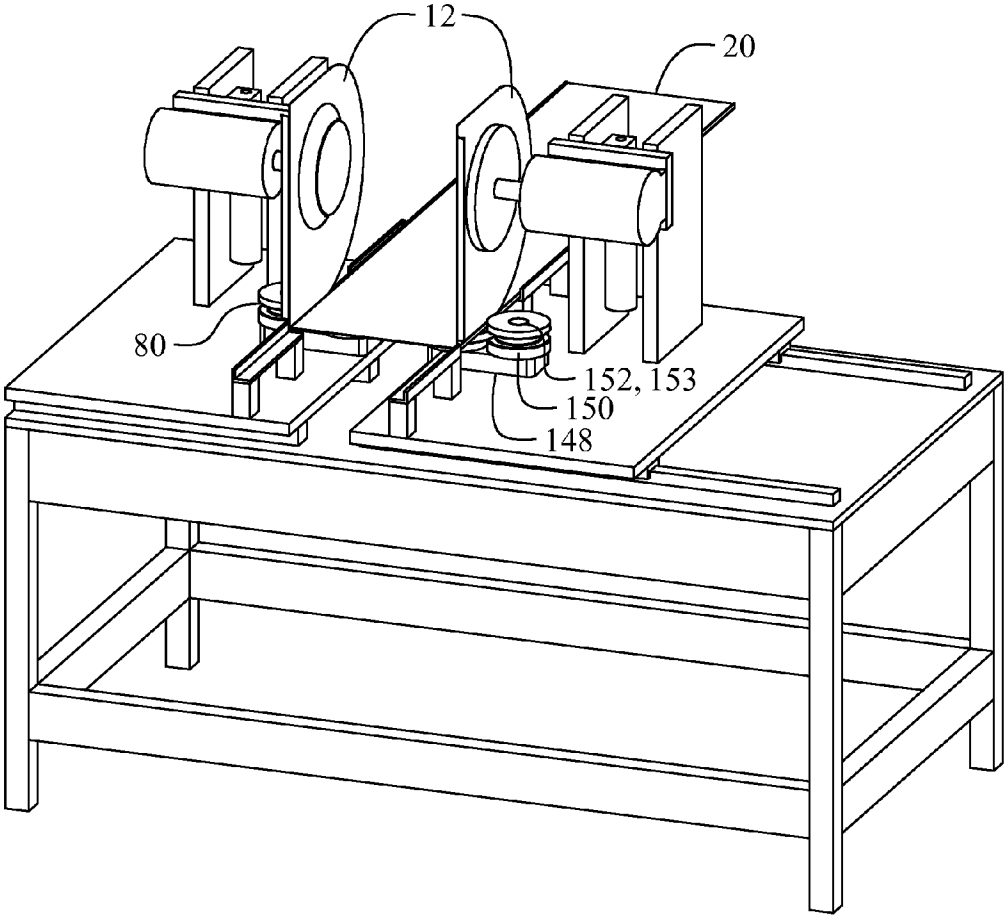
FIG. 2 is a right front diagrammatical perspective view thereof with housing panels and a wrapper inserted.
Figure 3:
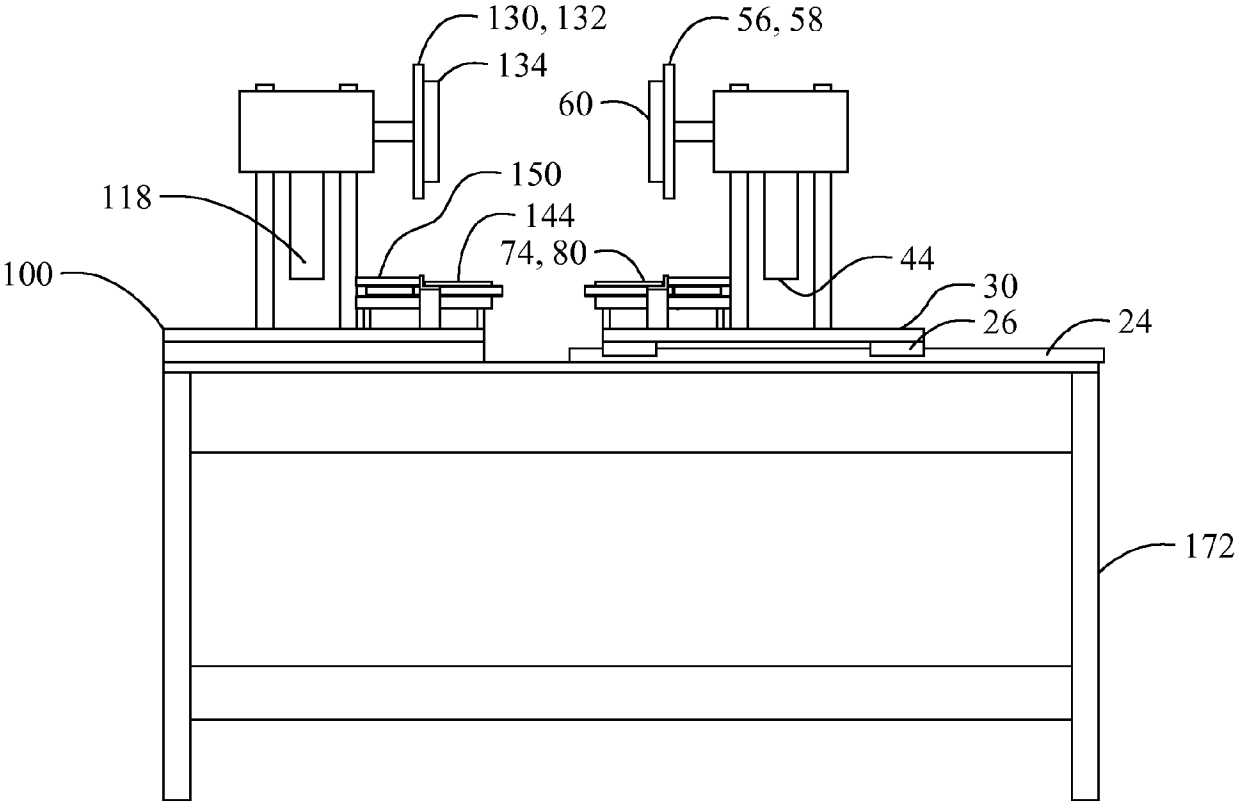
FIG. 3 is a front plan view of the embodiment shown in FIG. 1.
Figure 4:
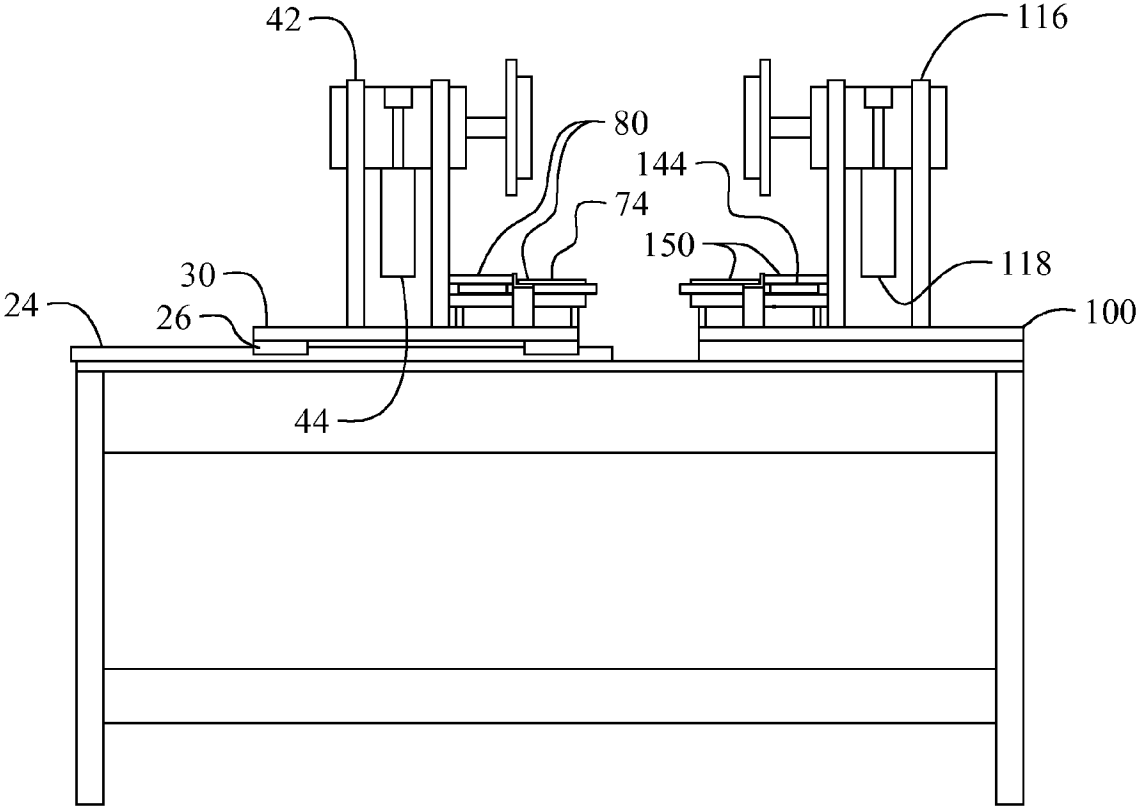
FIG. 4 is a rear plan view thereof.
Figure 5:
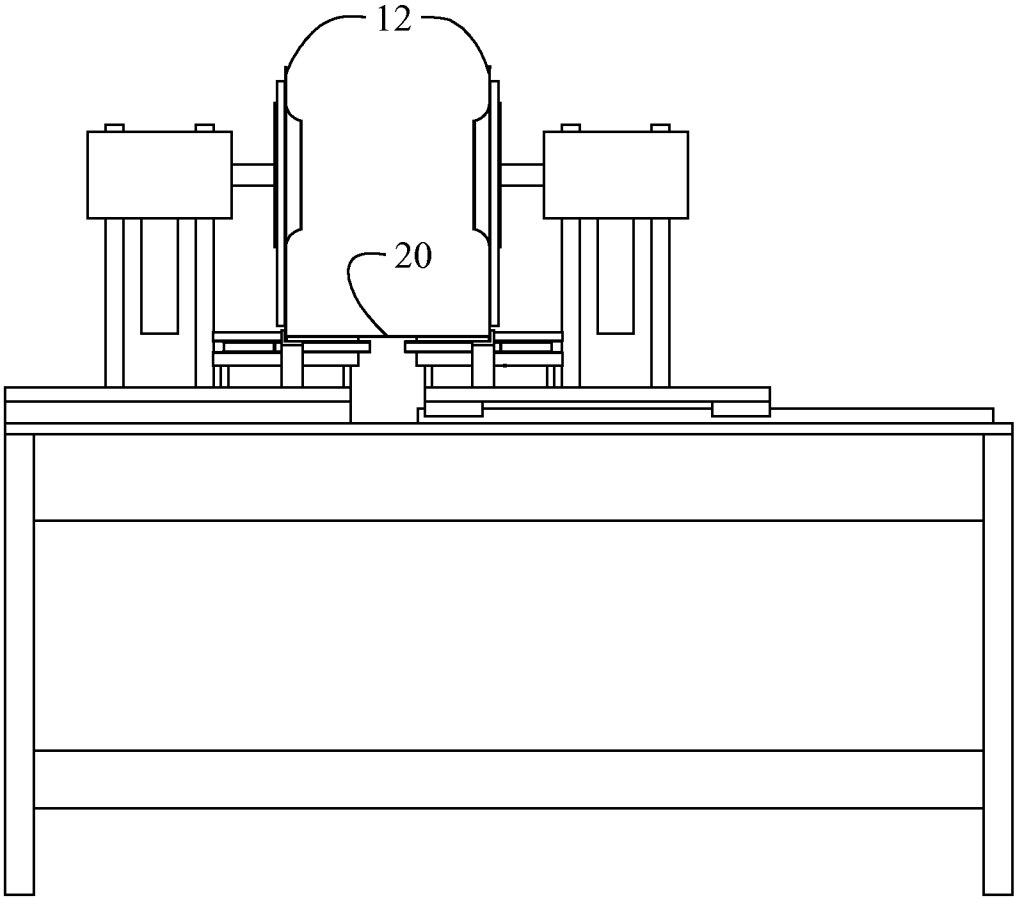
FIG. 5 is a front plan view of the embodiment shown in FIG. 2.
Figure 6:
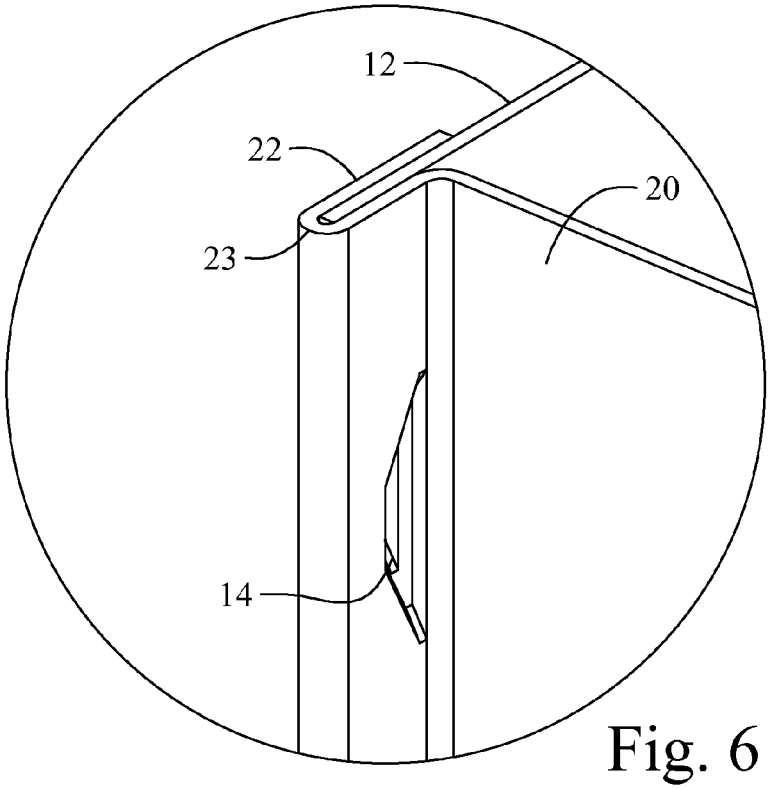
FIG. 6 is an inside detail view of a preferred embodiment housing wrapper edge flange having the present art lance and slit rolled seam.
Figure 7:
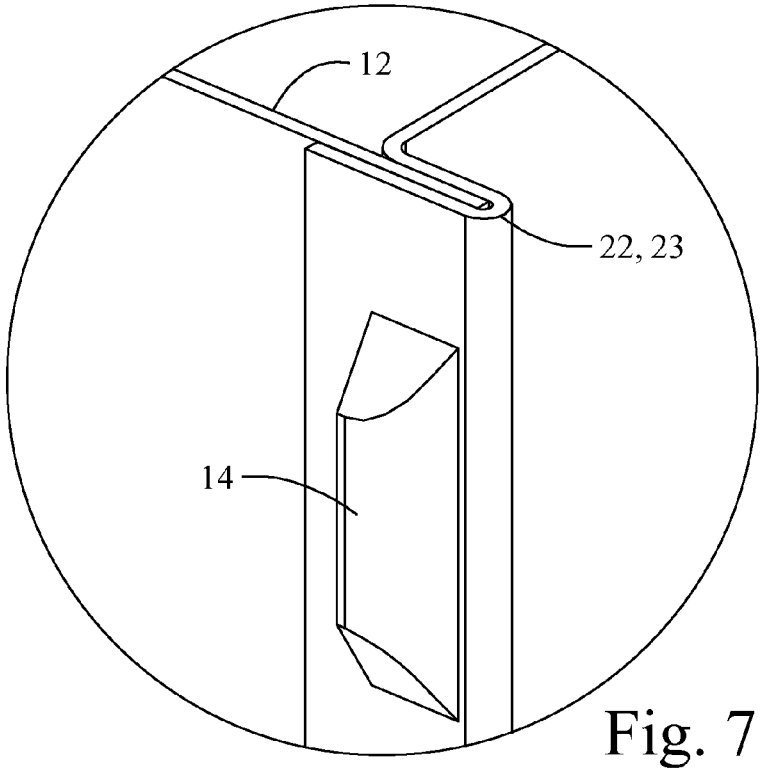
FIG. 7 is an outside detail view of a preferred embodiment housing wrapper edge flange having the present art lance and slit rolled seam.
Figure 8:
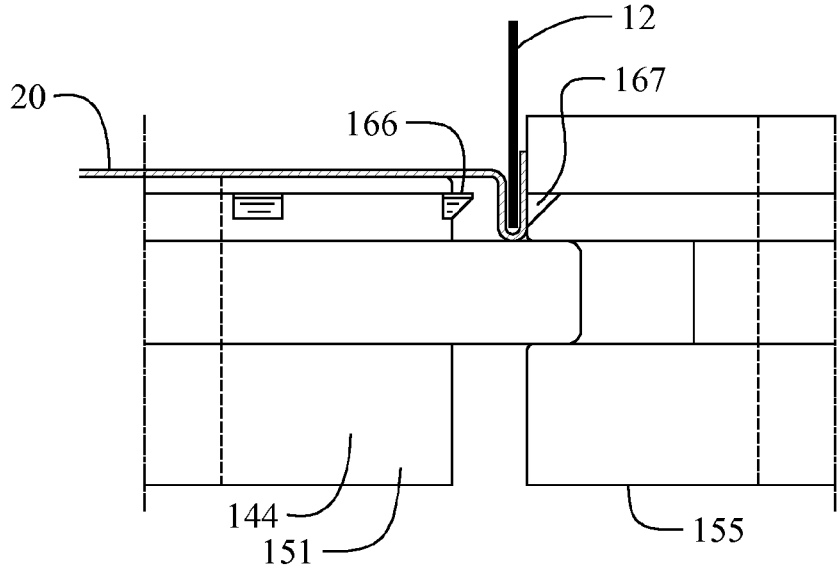
FIG. 8 is a detail front view of the FIG. 5 embodiment showing the mating portions of the lance and slit punch and rollers prior to seaming.
Figure 9:
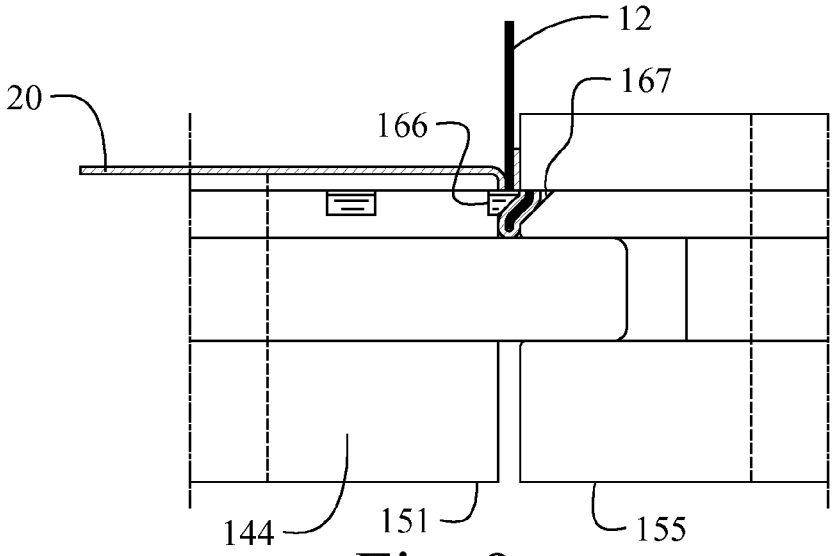
FIG. 9 is a detail front view of the FIG. 5 embodiment showing the mating portions of the lance and slit punch and rollers during seaming.
Figure 10:
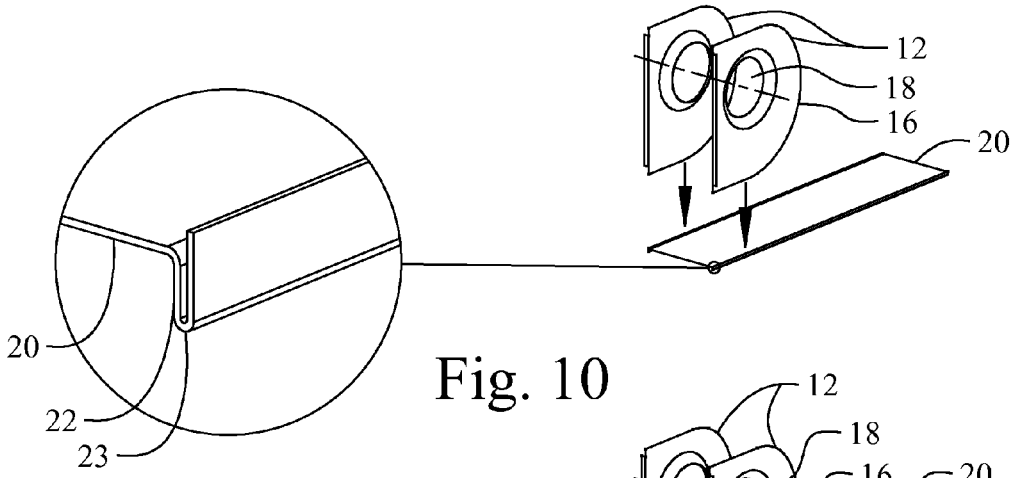
FIG. 10 is a perspective view of a preferred embodiment of the housing panels and wrapper prior to assembly.
Figure 11:
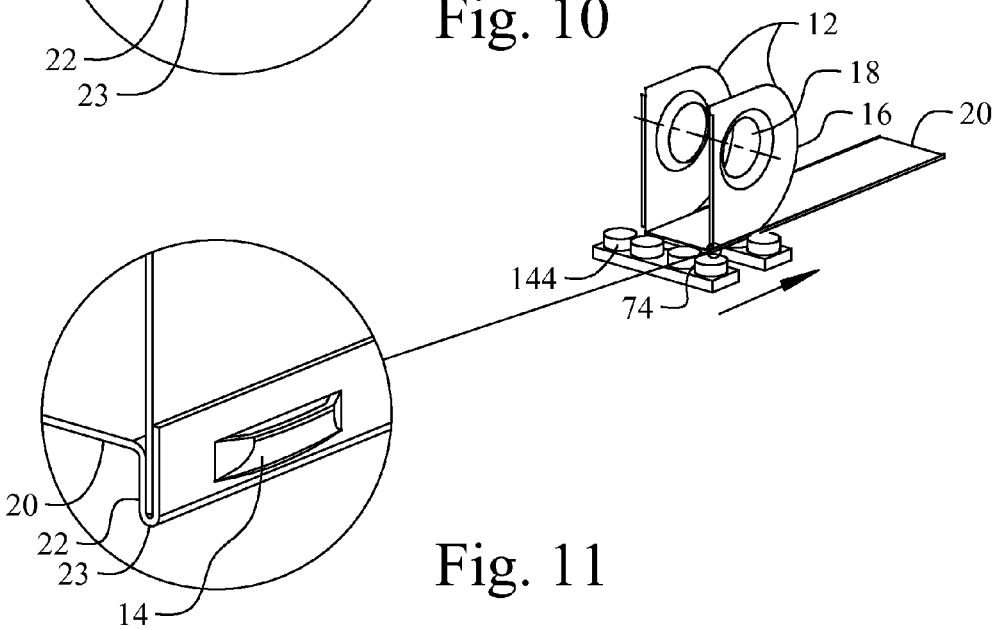
FIG. 11 is a perspective view of a preferred embodiment of the housing panels and wrapper at initiation of assembly utilizing the manufacturing apparatus of FIG. 5 and showing the relative movement of the form roller assemblies at a linear or straight portion of the housing.
Figure 12:
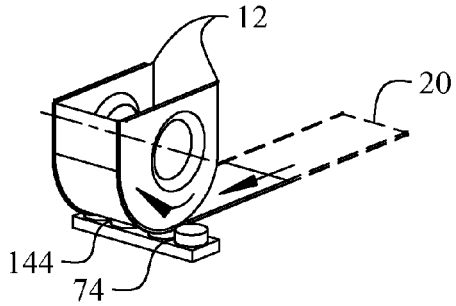
FIG. 12 is a perspective view of a preferred embodiment of the housing panels and wrapper approximately midway through assembly utilizing the manufacturing apparatus of FIG. 5.
Figure 13:
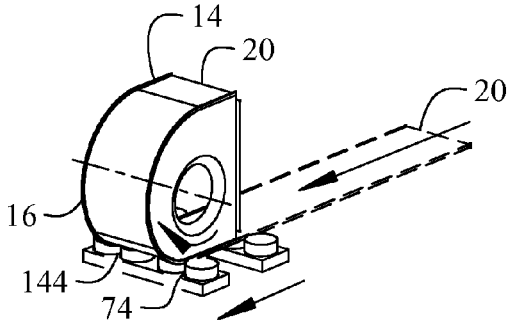
FIG. 13 is a perspective view of a preferred embodiment of the housing panels and wrapper substantially at the completion of housing assembly with the manufacturing apparatus of FIG. 5 and showing the relative movement of the form roller or roll assemblies at a linear or straight portion of the housing.
Figure 14:
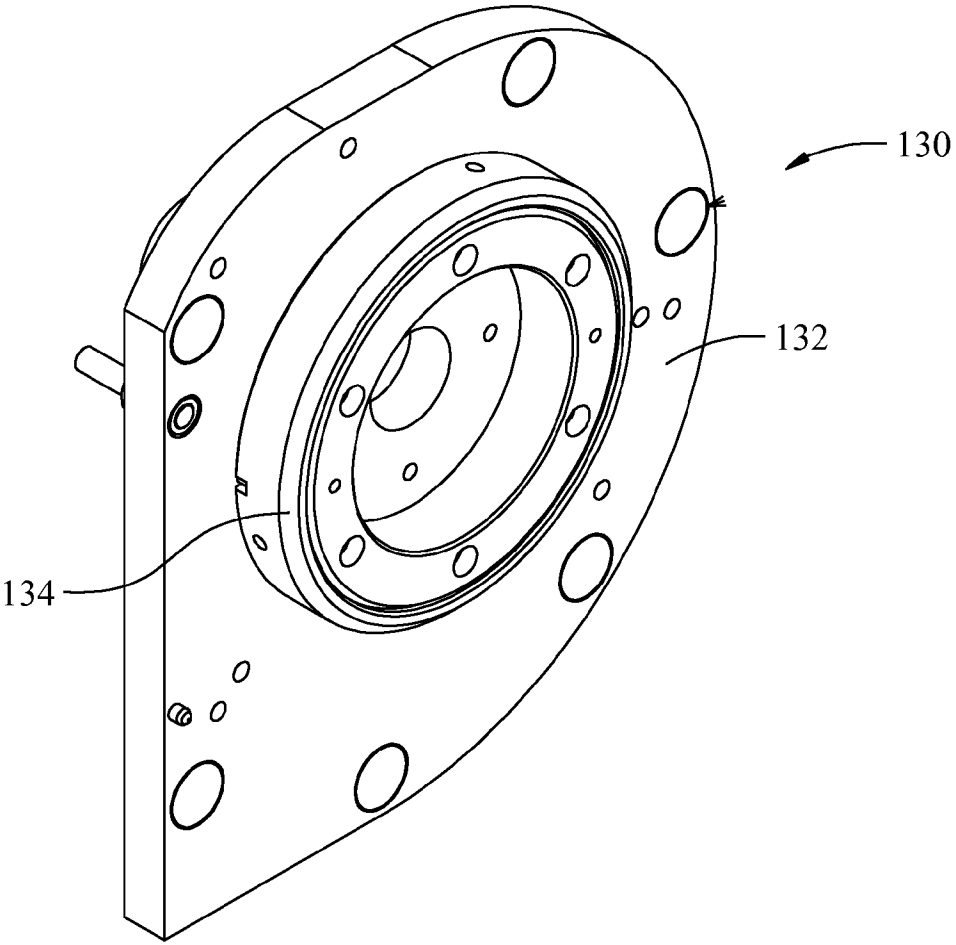
FIG. 14 is a detailed perspective view of a preferred embodiment of the left fixture showing the panel plate and venturi mandrel which is substantially symmetric with a right fixture.
Figure 16:
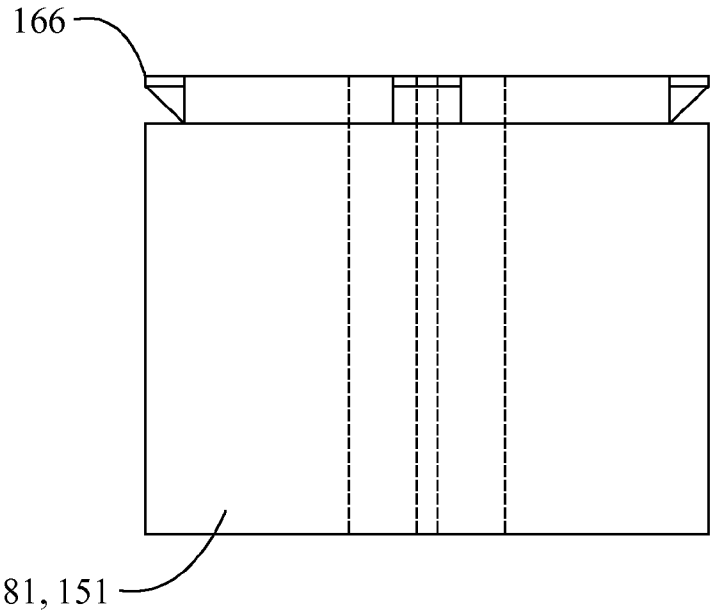
FIG. 16 is a side plan view of a preferred embodiment of a form roller showing the integral protrusions or punches.
Figure 15:
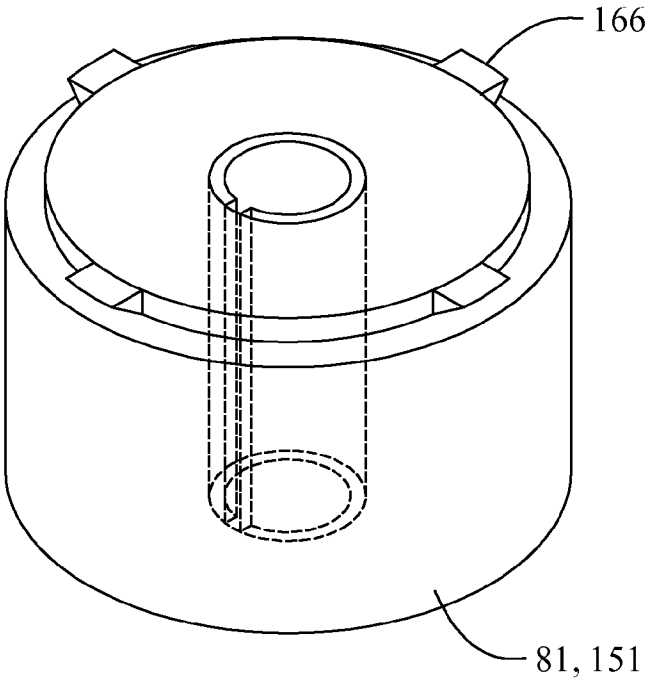
FIG. 15 is a front perspective view of a preferred embodiment of a form roller showing the integral protrusions or punches.
Figure 17:
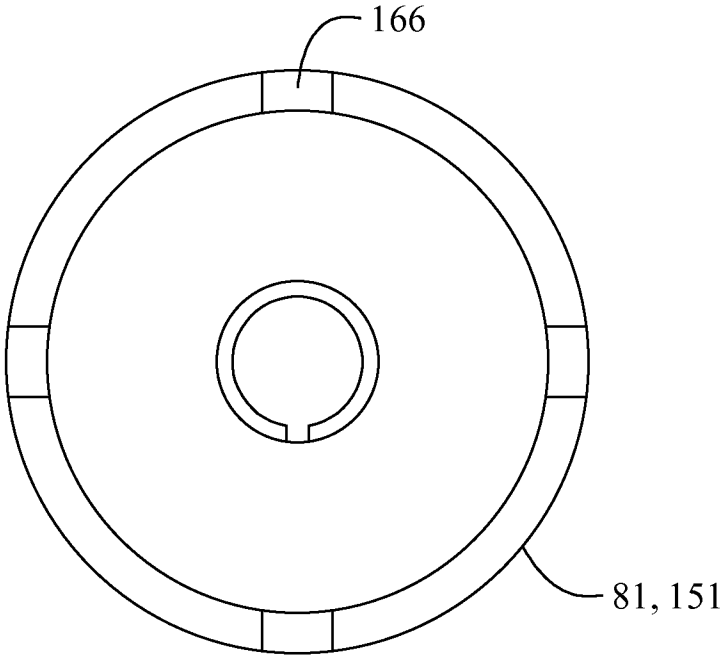
FIG. 17 is a top plan view of a preferred embodiment of a form roller showing the integral protrusions or punches.
Figure 18:
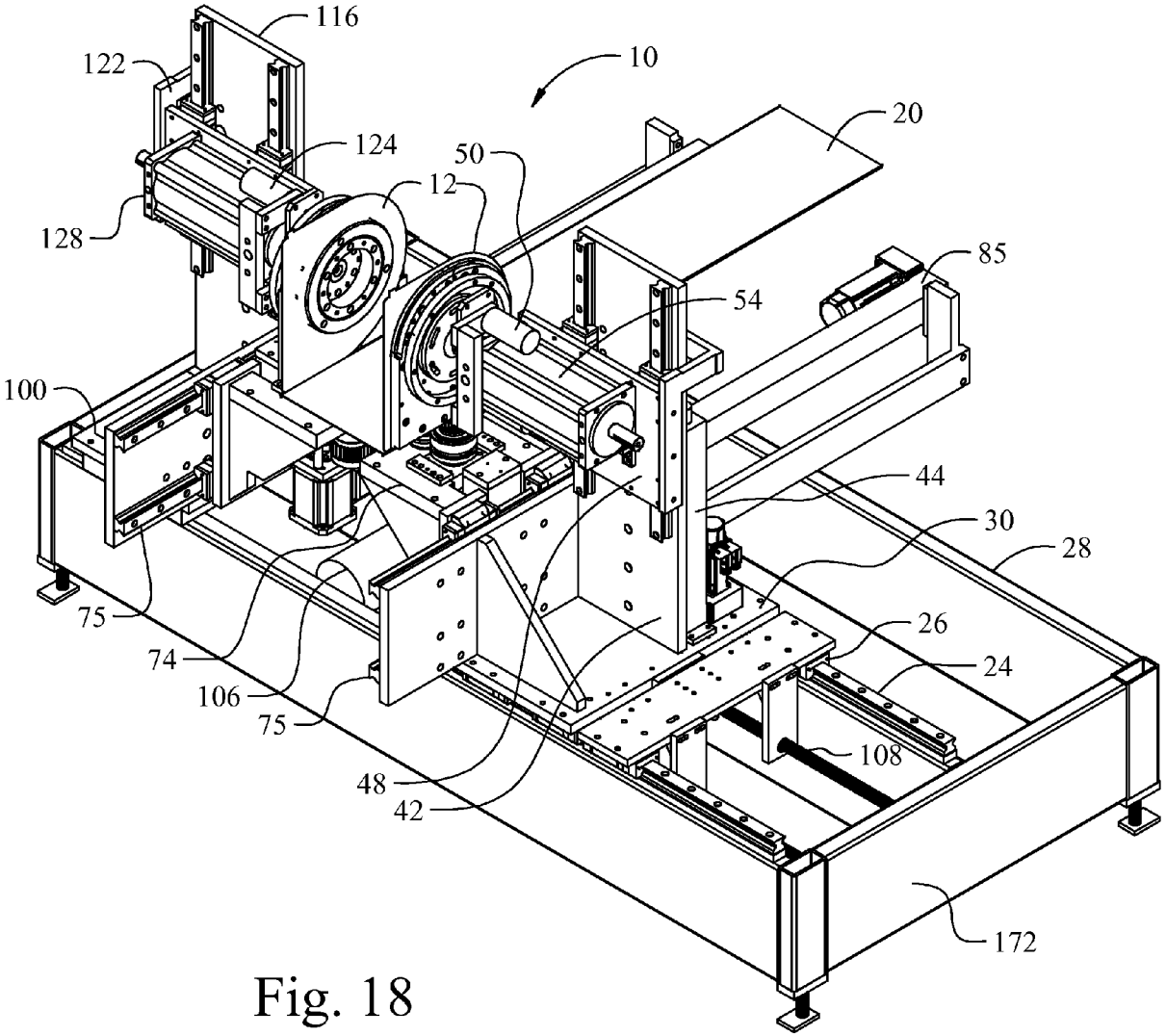
FIG. 18 is a right front detailed perspective view of the preferred embodiment of the apparatus for manufacturing the lance and slit seamed housing together with the housing panels and a wrapper.
Figure 19:
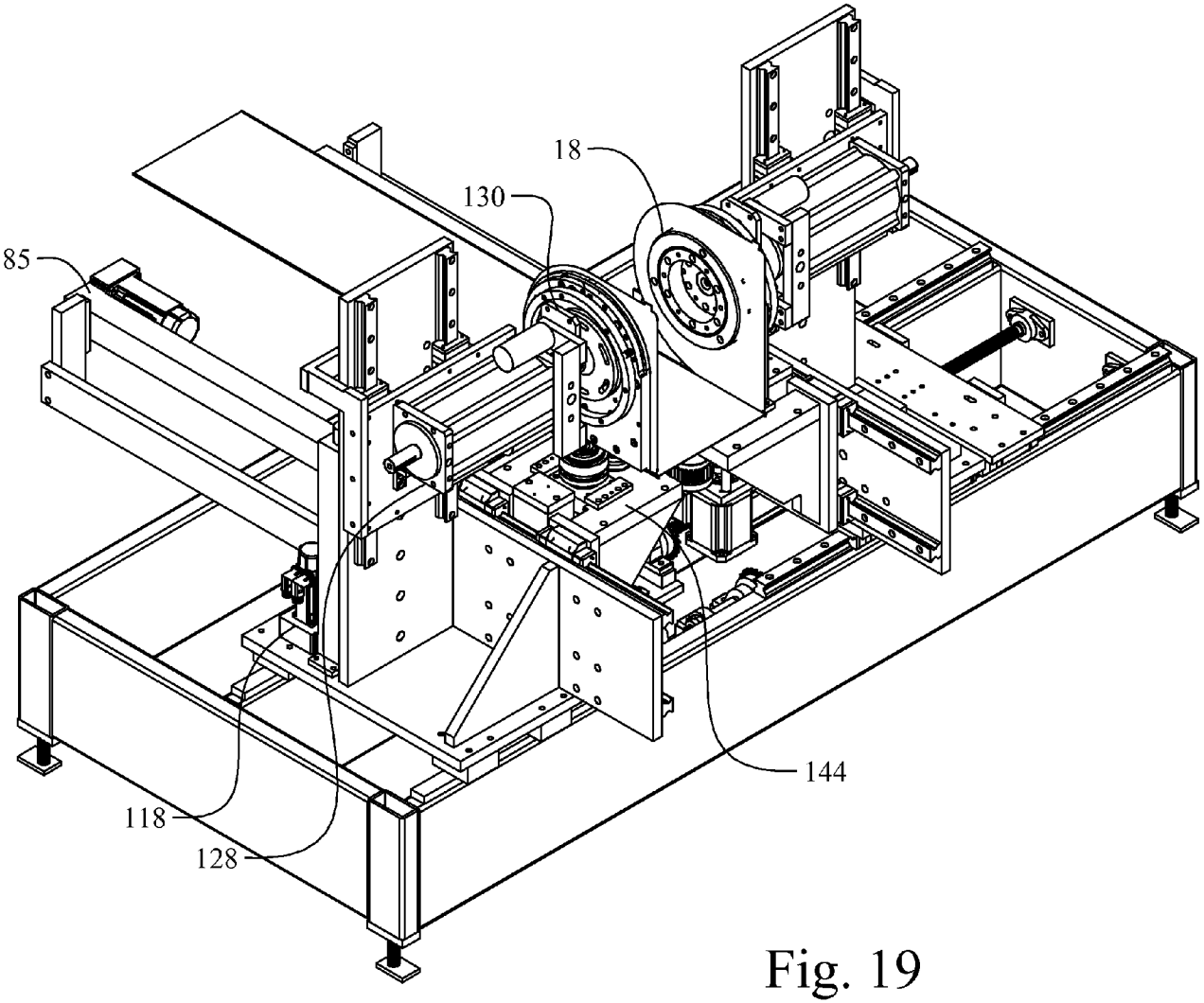
FIG. 19 is a left front detailed perspective view thereof.
Figure 20:
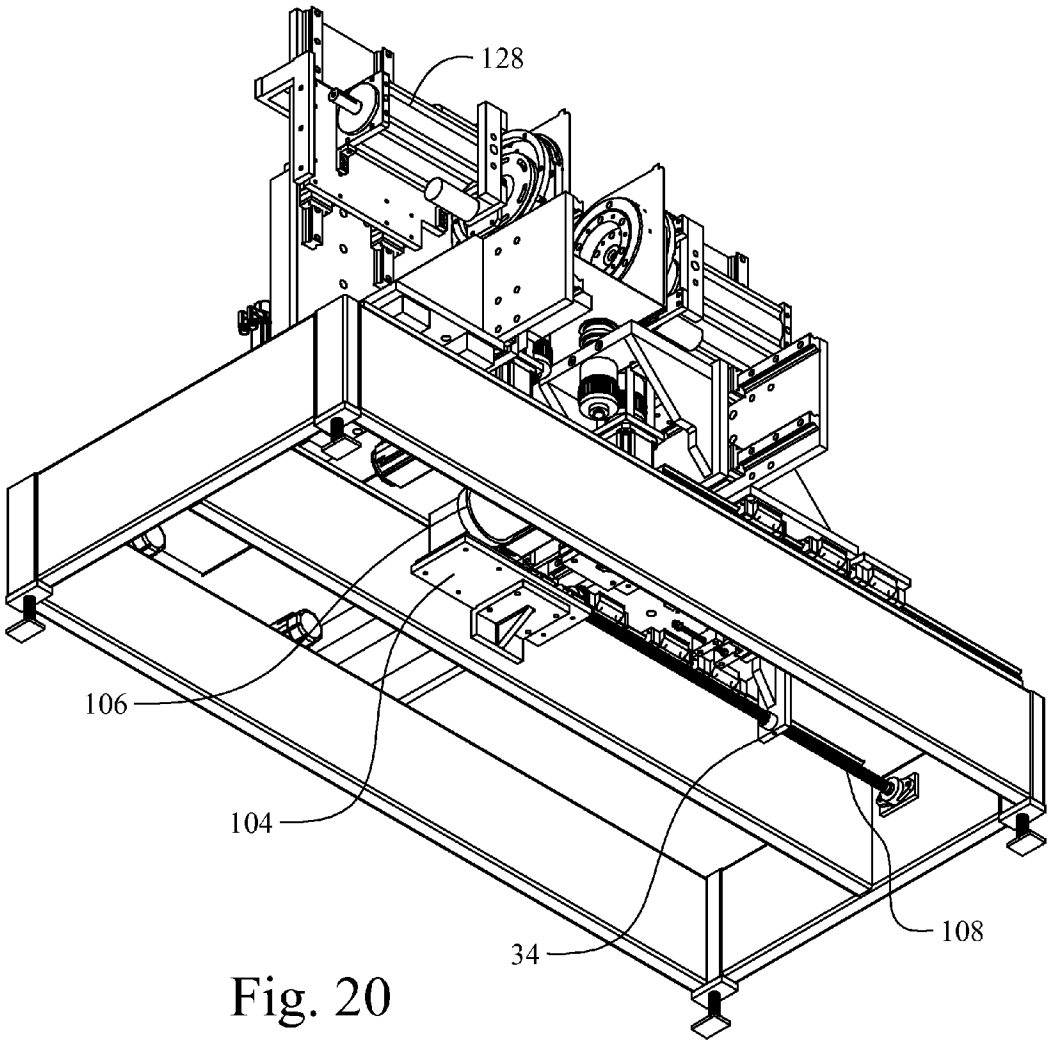
FIG. 20 is a bottom front detailed perspective view thereof.
Figure 21:
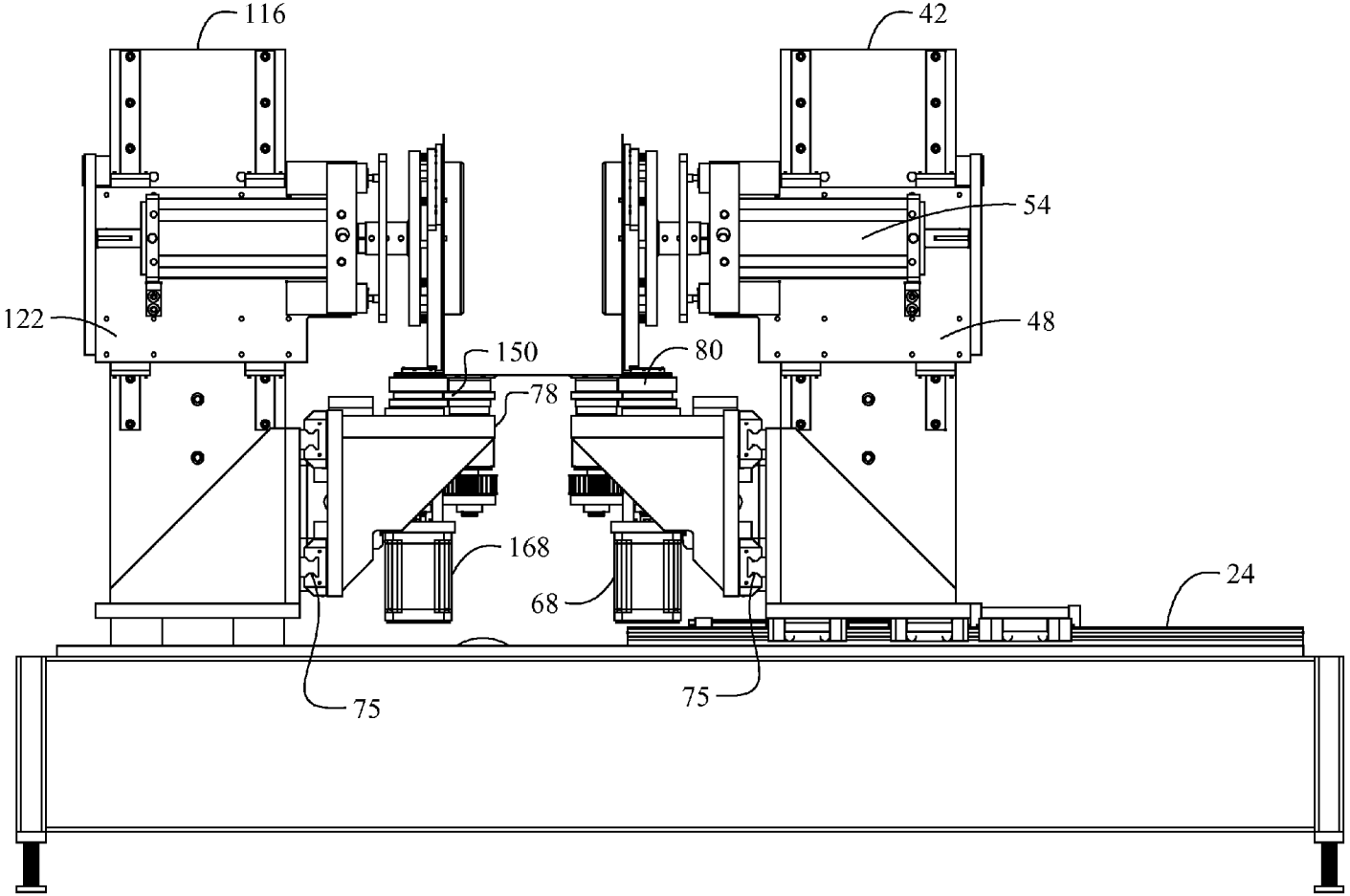
FIG. 21 is a front detailed plan view thereof.
Figure 22:
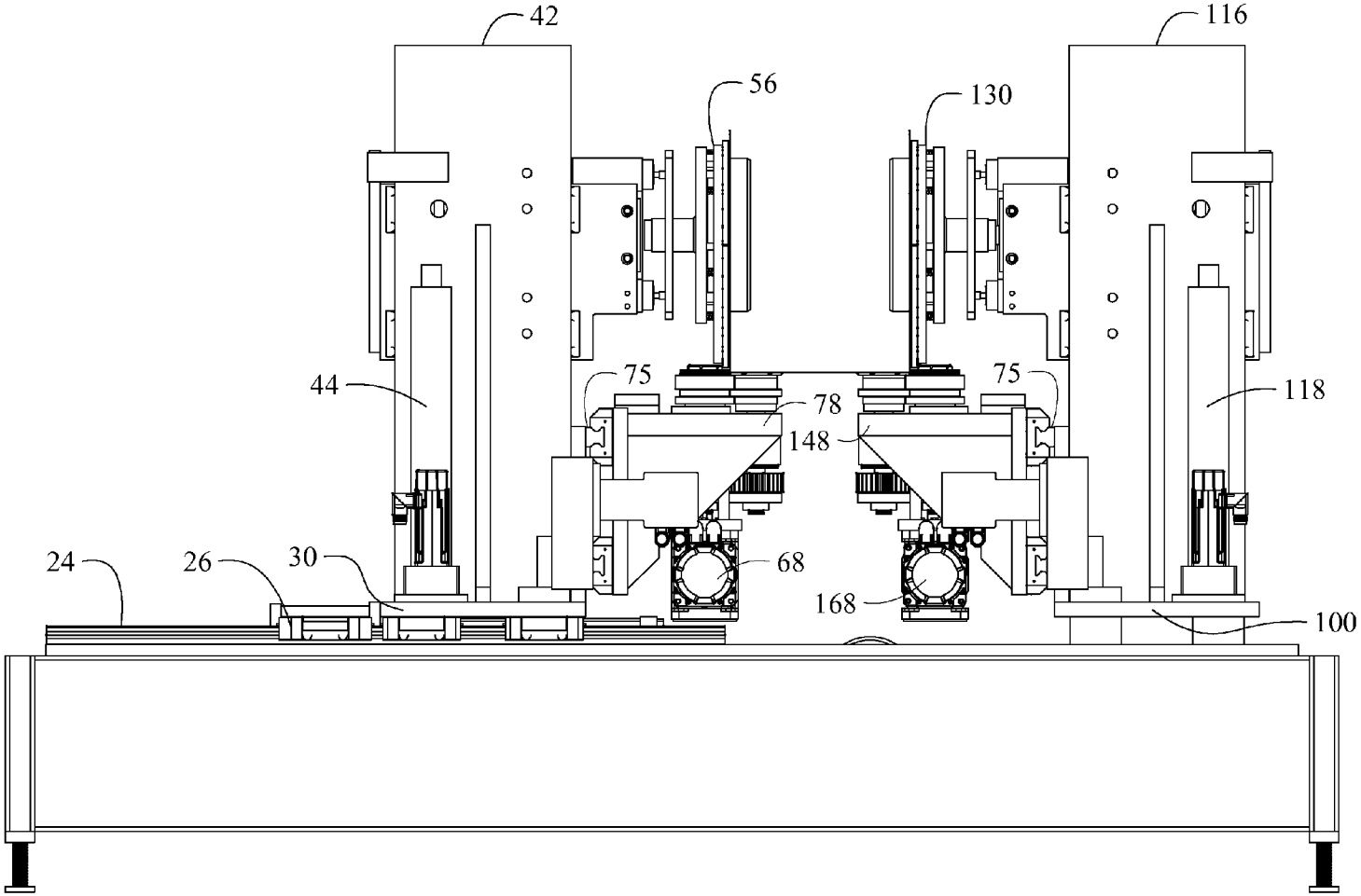
FIG. 22 is a rear detailed plan view thereof.
Figure 23:
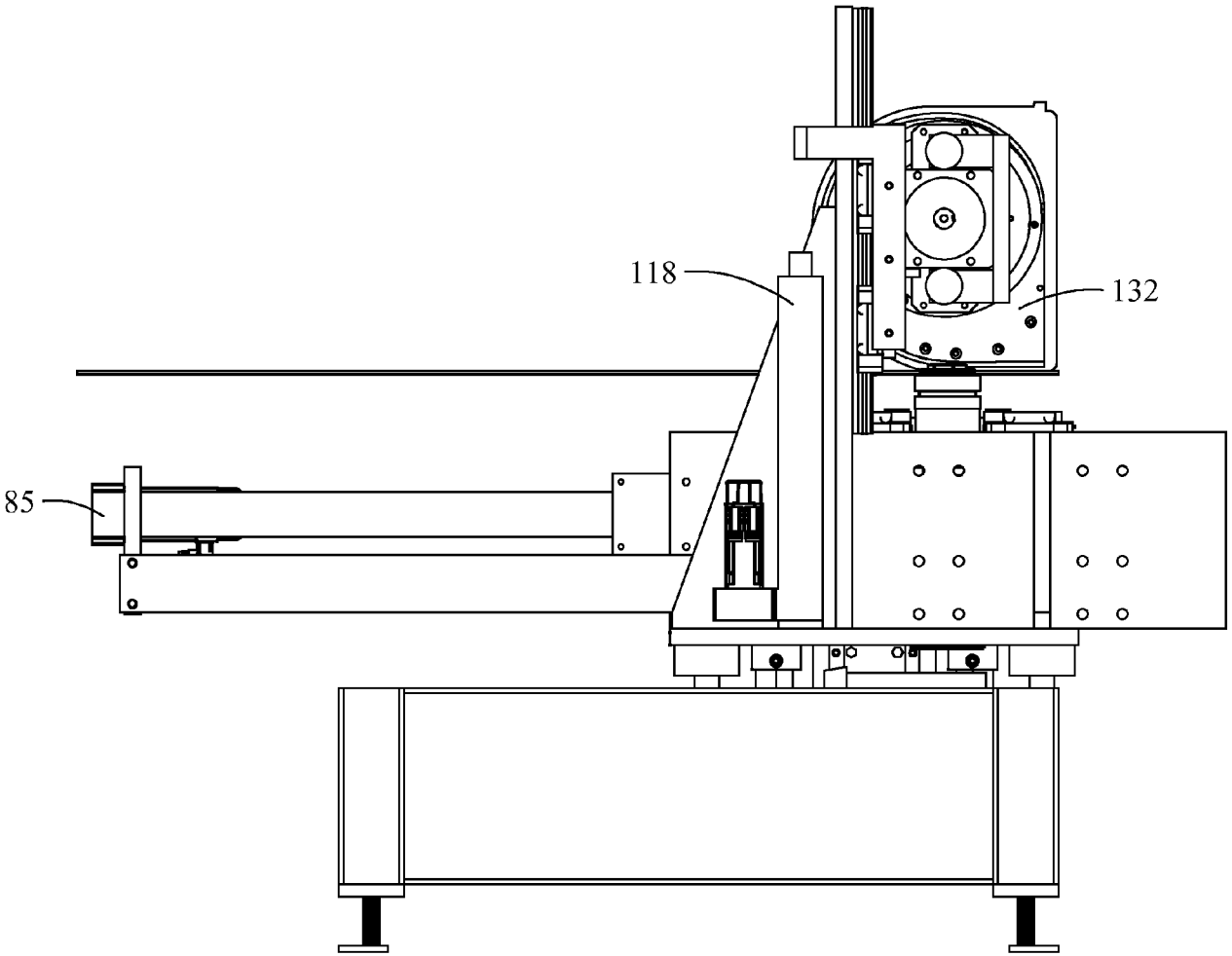
FIG. 23 is a left detailed plan view thereof.
Figure 24:
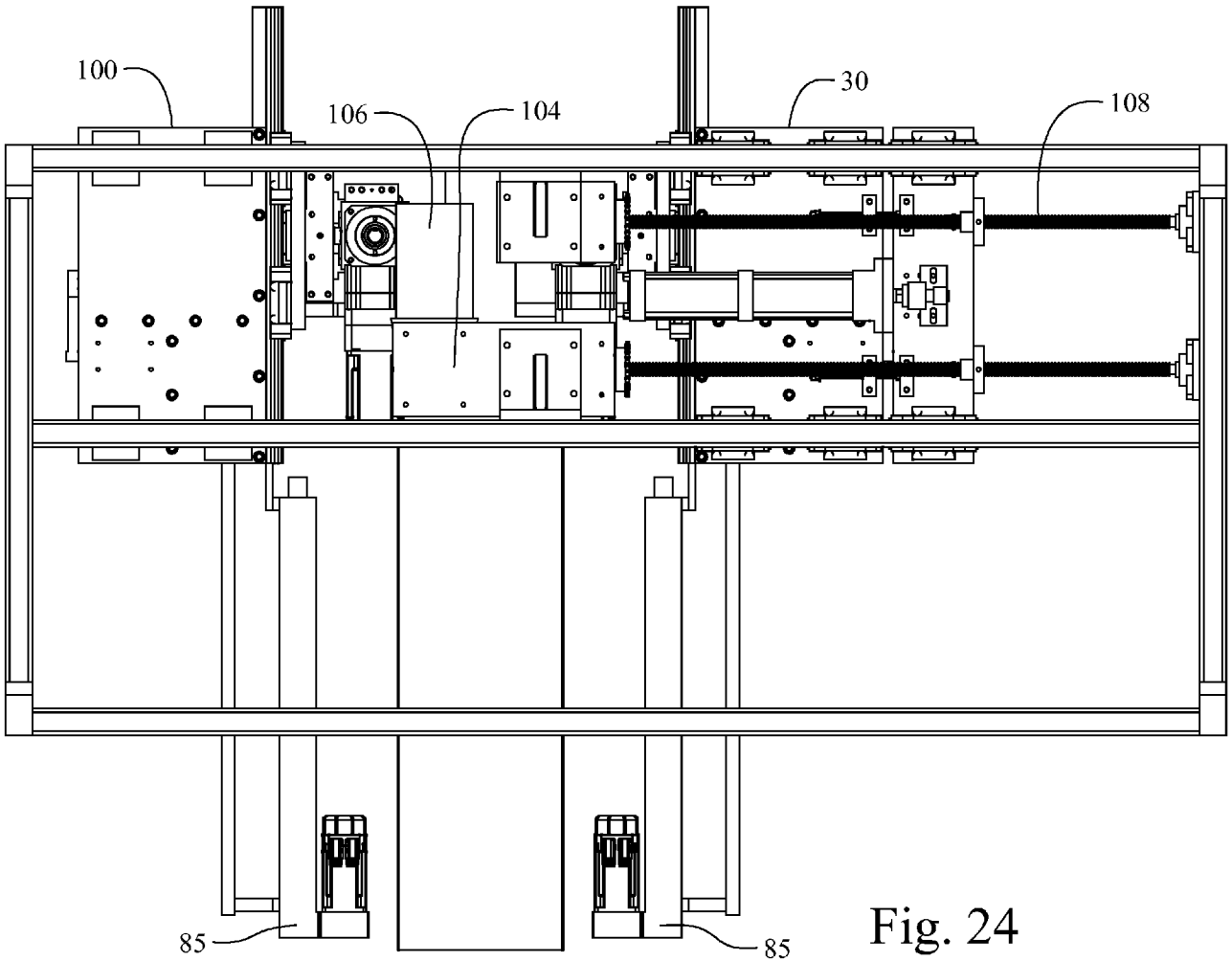
FIG. 24 is a bottom detailed plan view thereof.
Figure 25:
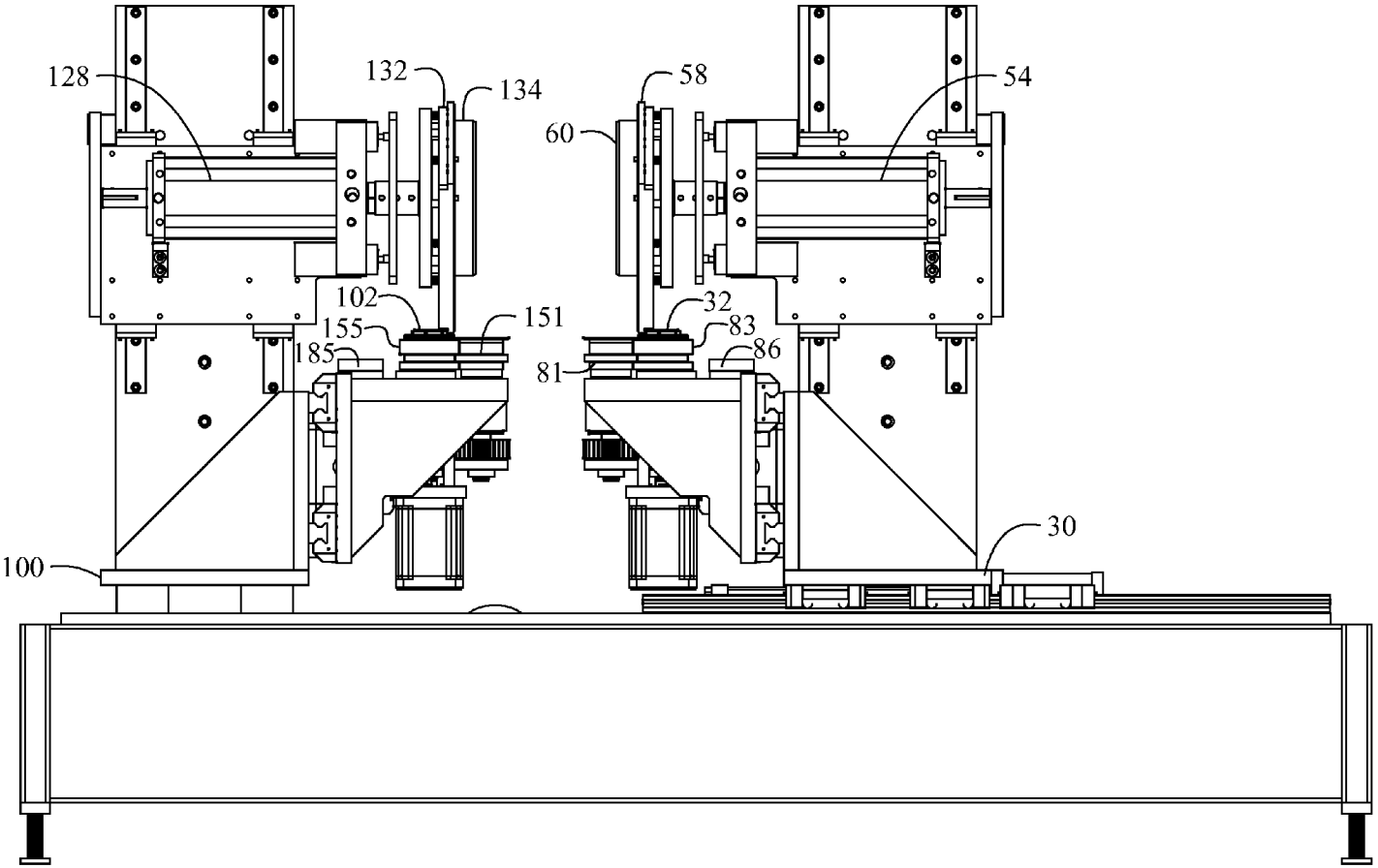
FIG. 25 is a front detailed plan view of the preferred embodiment of the apparatus for manufacturing the lance and slit seamed housing without the housing panels and a wrapper.
Figure 26:
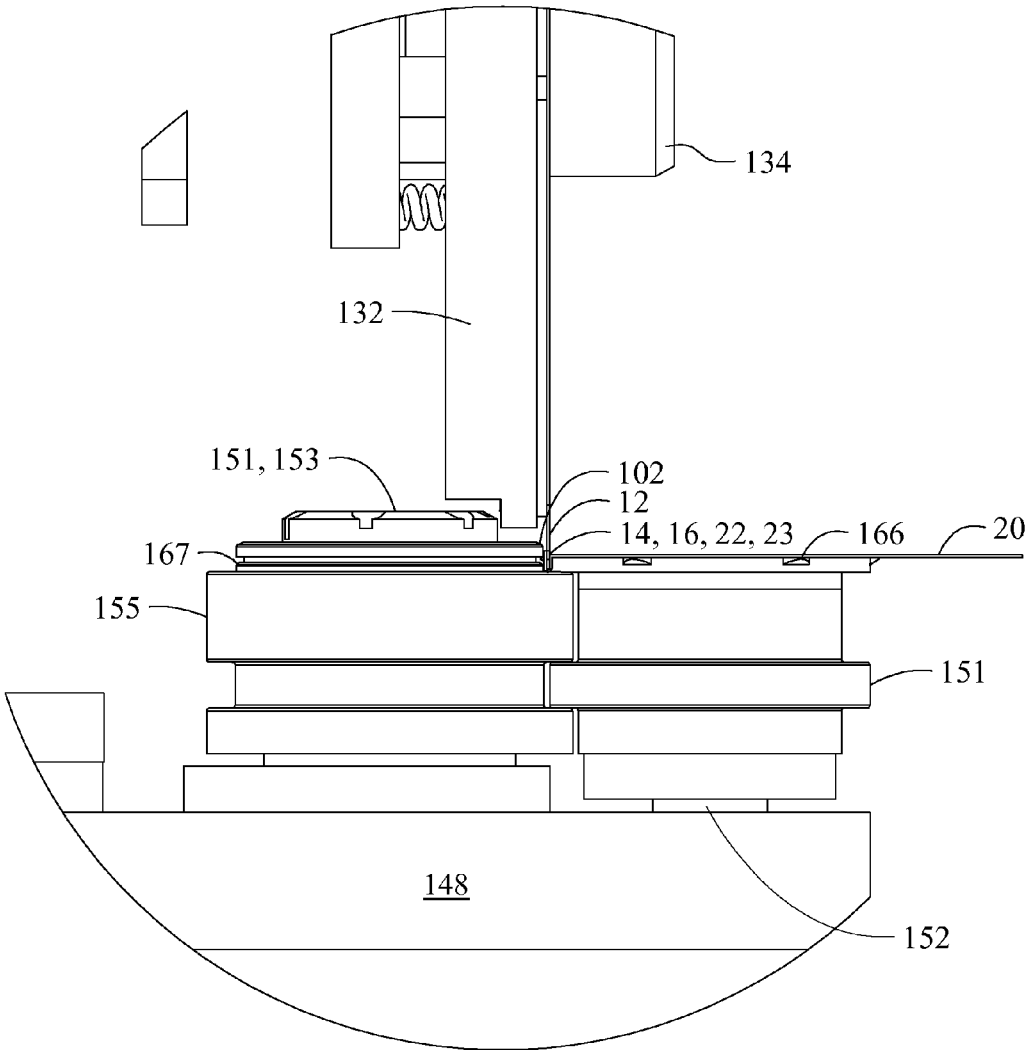
FIG. 26 is a front detailed plan view of the left rollers and a left housing panel and a wrapper during the seaming process.
Figure 27:
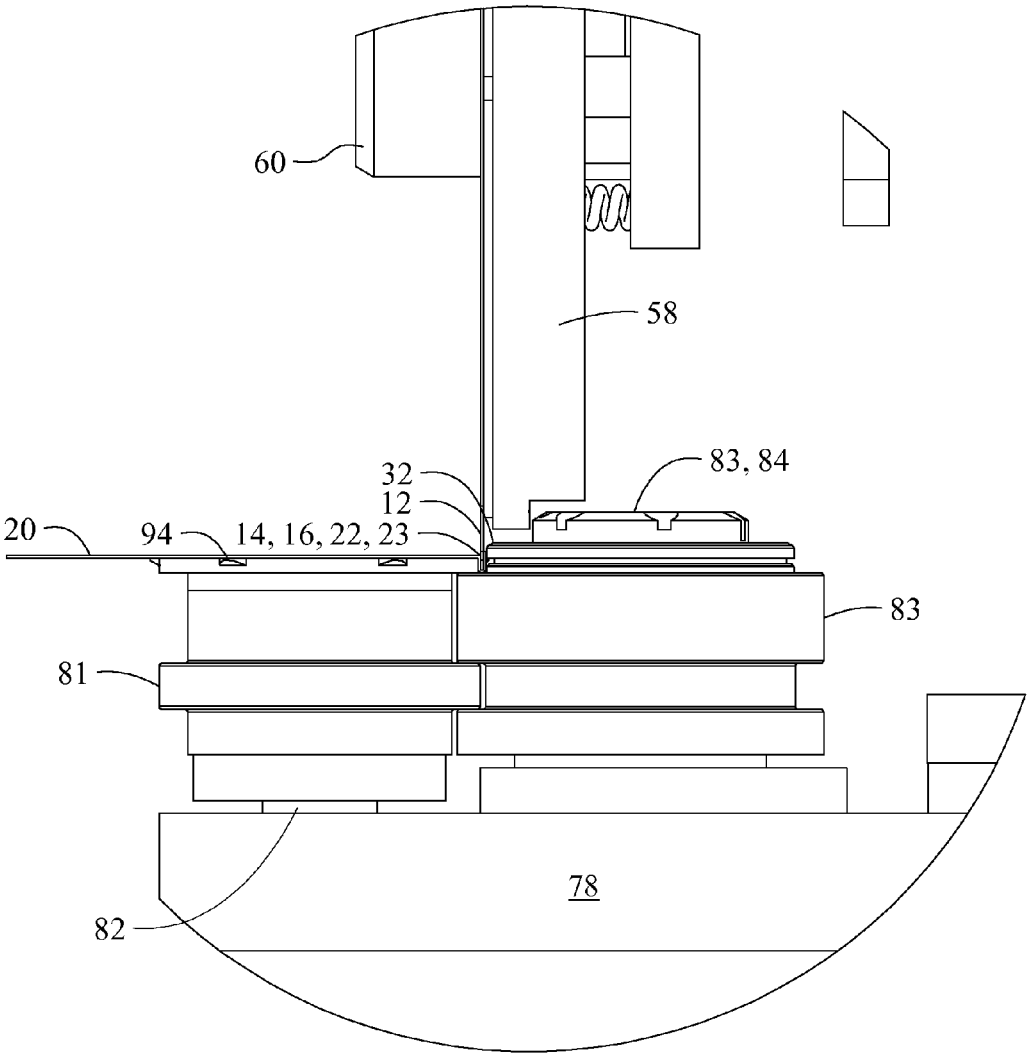
FIG. 27 is a front detailed plan view of the right rollers and a right housing panel and a wrapper during the seaming process.

Referring now to the drawings, there is shown in FIGS. 1-5 diagrammatical views of the preferred embodiment for the method of manufacture, in FIGS. 6-13 detailed views of the preferred embodiment housing panels and wrapper having the lanced and slit seams, and in FIGS. 14-27 detailed views of the preferred embodiment of the improved lance and slit seam housing and method of manufacture 10. The housing 10 and assembly apparatus 28 provide a quick, convenient, and structurally secure method of manufacturing a housing of virtually any size, shape, or style from a plurality of coated and uncoated materials and from materials of different thicknesses or compositions.

The lance and slit seam housing 10 comprises at least one (preferably two) housing panel(s) 12 and a wrapper 20, each having a periphery 16. The peripheries 16 of the wrapper 20 and housing panel 12 are rolled together and lanced and/or slit to form a lanced or slit seam 14. In a preferred embodiment, the wrapper has one or more edge flanges 22 (preferably two) or pockets into which a periphery 16 of a housing panel 12 seats or inserts and together with which is seamed and lanced and/or slit. The edge flanges 22 or pockets of the preferred embodiment are of an at least partially "U" form cross section with a separation between the legs of the "U" sufficient to insert said panel 12. Also in the preferred embodiment, the panels 12 of the housing 10 have a venturi opening 18 into which at least a portion of the pivotal or rotatable fixtures 56, 130 of the assembly apparatus 28 fit or mate. For the preferred embodiment, the peripheral 16 portions are rolled via one or more rollers 80, 150 which have one or more integral punches or protrusions 166 positioned at or near a roller circumferential edge. The punches or protrusions 166 perform a lancing or slitting operation on the rolled seam 14. Alternative embodiments may utilize individual punches 94, 166 which provide a punching operation upon the periphery 16 of the housing panels 12 or wrapper 20.

Unique to the present art is the secure co-attachment of the housing panels 12 and wrapper 20 without the need for welds or secondary assembly operations. The assembly apparatus 28 for performing the method of manufacture uniquely performs the entire assembly operation on a plurality of material types, thicknesses, and sizes, with and without coating, with a minimum of user input or handling. With the user able to minimize handling during the assembly process, user safety is maximized during the assembly process. Alternative embodiments may utilize edge flanges 22 which are of a cross sectional form other than a partially "U" form, including but not limited to "L" forms, pocketed forms, staked forms, pin indexed forms, or clipped forms.

For the preferred embodiment, each lance or slit seam 14 represents one or more (preferably a plurality) pressed indentations within the periphery 16 of the wrapper 20 and panels 12 along with the rolled seam 14. The indentations are pressed into the sandwich of the wrapper edge flanges 22 and the housing panel 12 periphery 16. The indentations force the wrapper 20 and panels 12 to lock together, thereby preventing undesirable rotation of the panels 12 relative to the wrapper 20. In addition to the lancing and/or slitting of the periphery 16, the seam 14 is rolled via one or more rollers 80, 150. For the preferred embodiment, the roller assemblies 74, 144 represent a mated pair of rollers 80, 150 with a first roller 81, 151 having one or more punches or protrusions 94, 166 which mate with one or more recesses 167 within a second roller 83, 155. Via a mechanical force between the mated pair of rollers 80, 150, an intimate sandwich is formed between the wrapper 20 and panels 12. Alternative embodiments of the housing 10 may place the edge flanges 22 or pockets on the housing panels 12 instead of the wrapper 20.

The preferred embodiment assembly apparatus 28 utilizes one or more first rollers 81, 151 which seam, rollform, and lance the periphery 16 against one or more second rollers 83, 155. The second rollers 83, 155 can be construed as roller seats. For the preferred embodiment, each seam 14 is formed with two rollers which sandwich the periphery 16 there between with one of the rollers acting as the seat. All embodiments may utilize one or more punches or protrusions 94, 166 which are integrally formed with one or more of the rollers 80, 150. Alternative embodiments may utilize a separate and adjacent punch 94, 166 which lances or slits the seam 14, the housing panels 12 periphery 16 or the wrapper 20 edge flanges 22.

The assembly apparatus 28 comprises a right base plate assembly 30 and a left base plate assembly 100, all of which sit upon a table, frame, weldment, or structure 172. For the preferred embodiment, the right base plate assembly 30 is moveable or slidable in a direction which is substantially perpendicular to the flow axis of the housing 10 wrapper 20 or laterally. The lateral movable or slidable attribute allows adjustment of the apparatus 28 for various widths of housings 10. The preferred embodiment moves or slides the right base plate assembly 30 on slide rails 24 which are mated with female slides 26 on an underside of the assembly 30. Alternative embodiments may utilize a plurality of mechanically accepted forms or assemblies to allow said sliding or moving. Although the preferred embodiment allows the right base plate assembly 30 to slide relative to the left base plate assembly 100, obvious variations such as the left base plate assembly 100 sliding, both base plate assemblies 30, 100 sliding, or an intermediate structure allowing lateral movement of portions of the assembly apparatus 28 is contemplated as within the scope of the present art 10. For the preferred embodiment, the base plate assembly 30 is driven or moves via a base plate horizontal drive assembly 104 having a motor drive 106 and a worm screw 108 mated with a threaded eyelet 34.

Each base plate assembly 30, 100 has one or more guides 32, 102 (right housing guide 32 and left housing guide 102) which may also be a portion of the rollers 80, 150. The guides 32, 102 may traverse from the rear to the front of the apparatus 28 or simply be formed as an extension or portion of the rollers 80, 150. The guides 32, 102 allow the extending lips 23 which are formed by the very geometric nature of the wrapper edge flanges 22 to be guided during the assembly process. The guides 32, 102 may be integrally mounted with the right and left base plate assemblies 30, 100 respectively or may be slidable, adjustable, rotatable, or mounted with different portions of the apparatus 28 in alternative embodiments.

In order to quickly and easily adjust the relative separation between the right and left base plate assemblies 30, 100, a base plate horizontal drive assembly 104 comprising a motor 106 and worm screw 108 is preferably mounted with the frame 172. For the preferred embodiment, the worm screw 108 extends through and is threaded with a threaded eyelet 34 mounted with the right base plate assembly 30. As shown in the preferred embodiment, the aforesaid 104, 106, 108, & 34 are mounted below the base plate assemblies 30, 100. As understood within the mechanical arts, the aforesaid 104, 106, 108, & 34 may be mounted in a plurality of locations and/or may comprise a plurality of hydraulic, pneumatic, mechanical, or electric actuators which provide quick and convenient base plate assembly 30, 100 adjustment.

For the preferred embodiment of the assembly apparatus 28, each base plate 30, 100 has a clamp mount 42, 116 (right side clamp mount 42 and left side clamp mount 116) and a form roller assembly 74, 144 (right form roller assembly 74 and left form roller assembly 144). Each form roller assembly 74, 144 is also movable or slidable in a direction or axis substantially parallel with the flow of the housing 10 wrapper 20 (i.e. linearly, parallel, or peripherally tangent to the peripheral 16 axis) on slide rails 75 via the action of a roller drive assembly 85 or simply via the action of the roller 80, 150 rotational force imparted to the wrapper edge flanges 22 and/or panel periphery 16. The roller drive assembly 85 may utilize a plurality of drive techniques including but not limited to worm screws, hydraulic or pneumatic actuators or pistons, chain drives, stepping motors, or electromagnetic drives. For the preferred embodiment, the roller drive assembly 85 is a motor driven linear actuator as understood within the mechanical arts.

The clamp mounts 42, 116 further comprise a vertical slide assembly 48, 122 (right vertical slide assembly 48 and left vertical slide assembly 122, respectively) which is moved and driven (or initially positioned for panel 12 loading) by a vertical positioner 44, 118 (right vertical positioner 44 and left vertical positioner 118, respectively). The vertical positioners 44, 118 are preferably motor driven linear actuators but may comprise a plurality of actuators such as the pneumatic, hydraulic, electromagnetic, or mechanical actuators in alternative embodiments. In the preferred embodiment, vertical positioning seats limit the vertical movement of each slide assembly 48, 122.

For an alternative embodiment, each of the vertical slide assemblies 48, 122 may have horizontal slide assemblies (right horizontal slide assembly and left horizontal slide assembly respectively) which are moveable in a substantially horizontal or lateral direction (i.e. substantially perpendicular to the flow of the housing 10 wrapper 20) in order to mate the fixtures 56, 130 with the housing panels 12. Each horizontal slide assembly is driven and positioned via a horizontal positioner 50, 124 which can be a pneumatic cylinder or a plurality of pneumatic, hydraulic, electromagnetic, or mechanical actuators.

Onto each horizontal slide assembly 52, 126 for the alternative embodiment or the vertical slide assemblies 48, 122 for the preferred embodiment is mounted a rotary motor 54, 128 having an extending shaft onto which each fixture 56, 130 is pivotally or rotatably mounted. Said rotary motor 54, 128 is preferably a pneumatic motor but may also comprise a plurality of pneumatic, hydraulic, electromagnetic, or mechanical rotary drives or actuators or simply be a non driven rotating shaft. As understood by one skilled within the art and as part of the method of manufacture, each motor 54, 128 and rotary roller drive assembly 68, 168 is controlled by and interfaced to a preprogrammed motion controller in order to optimally position the housing 10 during the assembly process.

For the preferred embodiment, each fixture 56, 130 comprises a panel plate 58, 132 and a venturi mandrel 60, 134, each of which are sized to the periphery 16 contour and venturi opening 18 of the housing panels 12. That is, the panel plate 58, 132 is smaller than the periphery 16 of the housing panel 12 in order that the seam 14 may be formed but preferably follows the periphery 16 curvature. The mandrel 60, 134 preferably fits closely or mates with the venturi opening 18 whereby the housing panels 12 may be precisely held and guided by the combined movement of the vertical positioners 44, 118 and the rotary motors 54, 128. The vertical positioners 44, 118 may further allow for initial positioning of said mandrels 60, 134 and fixtures 56, 130 and allow the camming action of the housing panels 12 to move the fixtures 56, 130 in all axis as the housing panels are rotated. Alternative embodiments may utilize fixtures 56, 130 having a plurality of sizes, shapes, and forms provided the housing panels 12 may be positioned in a precise fashion. Said fixture 56, 130 forms include but are not limited to clamps, pins, magnetic retainers, or suction retainers. One or more horizontal positioners 50, 124 are utilized to impart a lateral movement to the fixtures 56, 130 in order to engage and disengage the fixtures 56, 130 with the housing panels 12 during the seaming operation.

Also for the preferred embodiment, each roller assembly 74, 144 (right 74 and left 144 respectively) comprises a roller retainer 78, 148. Each roller retainer 78, 148 has an attached roller rotary drive assembly 68, 168 which actuates or moves the rollers 80, 150, preferably via a gearbox or gear reducer. That is, when the housing panels 12 and wrapper 20 are properly positioned and ready for the lance and/or slit seam 14, the roller rotary drive assemblies 68, 168 rotate the rollers 80, 150 and inherently move the roller retainers 78, 148 as necessary to form the seam 14. For the preferred embodiment, the rollers 81, 83 are coupled via a pair of meshed gears as are the rollers 151, 155. Also for the preferred embodiment, the rollers 83, 155 are slidably positioned relative to the rollers 81, 151 and actuated via a roller hydraulic actuator 86, 185 or other linear actuator capable of imparting the force necessary to form said seam 14. A plurality of actuator types may be utilized for the rotary roller drive assemblies 68, 168 and the roller actuators 86, 185, including but not limited to hydraulic actuators, mechanical actuators, rotary motors or actuators, or electromagnetic actuators in order to forcibly engage the rollers 80, 150 with the periphery 16 and form all or a portion of the seam 14. In a preferred embodiment, each roller retainer 78, 148 further comprises a roller shaft 82, 152, with a center axis 84, 153, onto which the rollers 80, 150 are mounted and through which the rotary motion of the roller rotary drive assemblies 68, 168 is imparted. As described, the preferred embodiment utilizes rollers 80, 150 having integrally and/or periodically mounted protrusions or punches 166 which engage the periphery 16 as rotated in order to form the lance and/or slit 14.

As contemplated by those skilled in the art, all of the aforesaid mechanical, pneumatic, and electrical components are interfaced with and controlled via a motion controller which is pre-programmable for the housing 10 size and shape. For the preferred embodiment, the motion controller is a G&L Digital Motion Controller which is preprogrammed with positioning data points. The controller and interface thereto may take a plurality of forms and technologies, including but not limited to electronic, mechanical, hydraulic, or pneumatic logic. The actuating components are preferably controlled via hydraulic or pneumatic valves which are controlled via the electronic controller. Preferred and alternative embodiments may utilize a plurality of interfacing elements between the controller and the pneumatic and electric components of the drives 54, 68, 104, 128, 168 and positioners 44, 50, 85, 86, 118, 124, 185. Said interfacing elements may be electrical, electromagnetic, pneumatic, hydraulic, mechanical, or combinations thereof as recognized within the art. The program or source code which supports the controller and the interfaces may take a plurality of forms which are recognized by those skilled within the pertinent arts and is therefore described herein by the process and function of the assembly apparatus 28 as a whole. It is further recognized that the controller is programmed to perform an operation for a particular size and shape of housing 10 and that said programming may be scalable and changeable.

The controller operates and controls the assembly apparatus 28 as hereafter described pursuant to the programming. An operator positions a wrapper 20 and two panels 12 within the apparatus 28 whereby the wrapper edge flange 22 extending lips 23 seat with the blower housing guides 32, 102 and the respective fixtures 56, 130 may engage and hold each panel 12. The horizontal positioners 50, 124 and/or the base plate horizontal drive assembly 104 moves the fixtures 56, 130 and/or the right base plate assembly 30 whereby the fixtures 56, 130 engage or disengage the panels 12 as preprogrammed within the controller. Preferably the venturi mandrels 60, 134 seat within the venturi openings 18 of the housing panels 12. The controller then actuates the roller hydraulic actuators 86, 185 whereby the wrapper edge flanges 22 extending lips 23 are sandwiched with the housing panel 12 peripheries 16.

The controller then actuates the rotary roller drive assemblies 68, 168 in order to rotatably engage the sandwich of wrapper edge flanges 22 and panels 12 between the rollers 80, 150 and begin the lance and seaming operation. If the lance and/or slit 14 seaming operating is on a substantially straight or linear portion of the housing 10 periphery 16, the form roller assemblies 74, 144 will move substantially linearly on the form roller slide rails 75 via the action of the rotary roller drive assemblies 68, 168 as allowed by the pre-programmed controller. The roller drive assembly 85 will simply act as a stop to the movement imparted by the rotary roller drive assemblies 68, 168.

Upon completion of a straight or linear portion, the rotary motors 54, 128 central axis (also construed as the center rotational axis of the fixtures 56) are substantially aligned to an axis which substantially aligns or parallels with the roller shaft 82, 152 center axis 84, 153 and the rotary motors 54, 128 begin a pre-programmed rotation or offer no resistance and allow the rotary roller drive assemblies 68, 168 to rotate the rotary motors 54, 128 or shafts during the seaming of the curved portion of the periphery 16 or a combination of both as pre-programmed into the controller. The rotation of the rotary motors 54, 128 is accompanied by movement of the vertical slide assemblies 48, 122 via the action of the vertical positioners 44, 118 or simply via the substantially vertical force of the wrapper 20 and housing panels 12 camming action during rotation as pre-programmed with the controller. This contemporaneous movement is often necessary as most housings 10 generally have a parabolic peripheral 16 curvature. (i.e. not a fixed radius) As further sections of the housing periphery 16 are encountered which are substantially straight or linear, the form roller assemblies 74, 144 will also move substantially linearly on the form roller slide rails 75. For substantially straight or linear sections, the clamp mounts 42, 116 may also move in lieu of or in addition to said form roller assemblies 74, 144.

The fixtures 56, 130 and rollers 80, 160 are thereafter retracted from the housing 10 via the action of the horizontal positioners 50, 124 and roller hydraulic actuators 86, 185, again as pre-programmed into the controller. The result is a completed housing 10 having a lanced and/or slit seam 14 rollformed onto the periphery 16 which may be removed from the apparatus 28. All of the aforesaid transpires with a minimum of operator interface and a maximum of operator safety.

From the foregoing description, those skilled in the art will appreciate that a lance and/or slit seam housing and method of manufacture 10 has been shown and described. The present art 10 quickly and safely forms a structurally strong housing from two or more panels and a wrapper in a safe and quick manner. The present art 10 further provides a housing which may be formed in a plurality of different shapes and from a plurality of different materials, including materials of different thicknesses and materials having various types of coatings.

Having described the invention in detail, those skilled in the art will appreciate that all the objects of the present invention are realized and that modifications may be made to the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A method of manufacturing a lanced seam housing, the steps comprising:

forming two or more side panels from a first metallic material, each having a periphery; and forming a wrapper from a second metallic material having one or more edge flanges, said edge flanges having one or more extending lips and formed into at least a partially "U" form cross section with a leg separation of the "U" sufficient to at least partially insert said periphery of said side panel; and inserting said periphery of said side panels at least partially into said edge flanges; and seating one or more of said lips of said edge flanges with one or more form roller assemblies of an assembly apparatus; and substantially affixing said side panels to one or more pivotal fixtures of said assembly apparatus and allowing said side panels to rotate with said pivotal fixtures, said fixtures pivotally connected with one or more vertical slide assemblies; and positioning one or more of said form roller assemblies of said assembly apparatus with said one or more of said edge flanges, each of said form roller assemblies having two driven and mated rollers which are coupled via meshed gears and of said two rollers a first roller having one or more protrusions mating with one or more recesses within a second roller and a roller actuator capable of imparting a force necessary to form a seam from a three layers of said first and said second metallic materials; and actuating one or more of said roller actuators whereby said form roller assembly places a force onto said edge flange and said force is sufficient to form a rolled seam having an intimate three layer sandwich between at least a portion of said housing panel periphery and said wrapper edge flanges; and moving one or more of said rollers or pivoting one or more of said fixtures or vertically sliding one or more of said vertical slide assemblies while maintaining said force and said sandwich and thereby rolling a seam; and driving said rollers and pressing one or more lances, or slits within said three layer sandwich and into each of said legs of said "U" and said periphery and edge flanges via said one or more protrusions mating with said one or more recesses one or more times whereby a housing is formed with said side panels lance locked with said wrapper whether said first and second metallic materials are coated, not-coated, or dissimilar and said seam is rolled without a gap within said three layer sandwich and has one or more of said lances, or slits without requirement of an indexing.

2. The method of manufacturing a lanced seam housing as set forth in claim 1, the steps further comprising:

attaching a punch and a punch actuator with said roller assembly whereby a punching occurs via said punch contacting said seam via the actuation of an actuator during said rolling of said seam.

3. The method of manufacturing a lanced seam housing as set forth in claim 1, the steps further comprising:

forming one or more venturi openings within said housing panels; and forming one or more mandrels onto said fixtures which are sized to at least partially mate with said venturi openings; and inserting one or more of said mandrels into said venturi openings whereby said affixing of said side panel to said fixture occurs.

4. The method of manufacturing a lanced seam housing as set forth in claim 3, the steps further comprising:

placing one or more vertical positioners with one or more of said vertical slide assemblies whereby said vertical positioner may move said vertical slide assembly; and connecting one or more roller drive assemblies with one or more of said roller assemblies whereby one or more of said rollers may rotate; and connecting one or more rotary motors or rotary shafts with one or more of said fixtures whereby said fixture may pivot.

5. The method of manufacturing a lanced seam housing as set forth in claim 4, the steps further comprising:

attaching one or more horizontal positioners with one or more of said vertical slide assemblies whereby said fixtures are able to engage or disengage said panels.

6. The method of manufacturing a lanced seam housing as set forth in claim 4, the steps further comprising:

driving one or more horizontal drive assemblies and thereby moving one or more of said slide assemblies whereby said fixtures are able to engage or disengage said panels.

7. The method of manufacturing a lanced seam housing as set forth in claim 4, the steps further comprising:

driving one or more roller drive assemblies and thereby moving one or more of said roller assemblies to engage or disengage one or more of said edge flanges.

8. A method of manufacturing a lanced seam housing, the steps comprising:

forming two or more housing panels from a first metallic material and each having a periphery; and from a second metallic material forming a wrapper having edge flanges with at lease a partially "U" form cross section with a leg separation of the "U" sufficient to at least partially insert said periphery and within which said periphery may at least partially mate; and said first metallic material and second metallic material comprising one or more materials which are similar, dissimilar, or painted; and mating at least a portion of said periphery within said edge flanges; and rotatably holding said housing panels with one or more rotatable fixtures; and forming one or more roller assemblies with one or more driven and mated pairs of rollers; and forming one or more protrusions mating with one or more recesses within said mated pair of rollers and coupling said mated pair of rollers via meshed gears; and positioning said roller assembly against said edge flange and sandwiching said panel periphery and said edge flange between said mated pair of rollers; and driving said rollers and allowing said housing panels to rotate while maintaining a distance between one or more of said rollers which maintains said sandwiching; and pressing one or more lances, or slits simultaneously within said edge flange and each leg of said "U" and said panel periphery via said one or more protrusions mating with said one or more recesses thereby forming a lance locked and rolled seam without a gap between said edge flange and said periphery and a housing.

9. The method of manufacturing a lanced seam housing as set forth in claim 8, the steps further comprising:

forming one or more venturi openings in one or more of said housing panels; and forming one or more mandrels on one or more of said fixtures which mates with one or more of said venturi openings.

10. The method of manufacturing a lanced seam housing as set forth in claim 9, the steps further comprising:

forming one or more punches in conjunction with one or more of said rollers.

* * * * *